US005599484A

United States Patent [19]

Tobinai

[11] Patent Number: 5,599,484

[45] Date of Patent: Feb. 4, 1997

[54] CONSTRUCTION OF A FUEL SUPPLY PIPE IN A ROTARY THROTTLE VALVE TYPE CARBURETOR

[75] Inventor: Teruhiko Tobinai, Sendai, Japan

[73] Assignee: Walbro Japan, Inc., Tokyo, Japan

[21] Appl. No.: 519,308

[22] Filed: Aug. 25, 1995

[30] Foreign Application Priority Data

Oct. 6, 1994 [JP] Japan ..... 6-268393

[51] Int. Cl.[6] ..... F02M 9/08

[52] U.S. Cl. ..... 261/44.2; 261/44.8; 261/35; 261/DIG. 68; 261/DIG. 8

[58] Field of Search ..... 261/44.2, 44.8, 261/DIG. 68, 35, DIG. 8

[56] References Cited

U.S. PATENT DOCUMENTS 3,711,068 1/1973 Perry ..... 261/44.2

3,943,207 3/1976 Harootian ..... 261/44.2

4,481,152 11/1984 Kobayashi et al. ..... 261/44.8

4,481,153 11/1984 Kobayashi et al. ..... 261/44.2

*Primary Examiner*—Tim R. Miles

*Attorney, Agent, or Firm*—Barnes, Kisselle, Raisch, Choate, Whittemore & Hulbert

[57] ABSTRACT

A construction of a fuel supply pipe with a proximal end press-fit portion formed of metal and a metering tip portion formed of synthetic resin. The metering tip portion, formed with a fuel jet therein, is telescopically connected to the proximal end press-fit portion of the fuel supply pipe to provide a stable fuel supply in a rotary throttle valve type carburetor.

6 Claims, 2 Drawing Sheets

CONSTRUCTION OF A FUEL SUPPLY PIPE IN A ROTARY THROTTLE VALVE TYPE CARBURETOR

FIELD OF THE INVENTION

This invention relates to a carburetor and more particularly to a construction of a fuel supply pipe in a rotary throttle valve type carburetor which is suitable for small, 2-stroke, internal combustion engines.

BACKGROUND OF THE INVENTION

Japanese Patent Application Laid Open No. 62(1987)-55449 discloses a rotary throttle carburetor with a needle inserted into a metering tip portion of a fuel supply pipe to meter fuel by adjusting the outlet area of a fuel jet contained within the metering tip portion of the fuel supply pipe. Particularly, the needle is incorporated into the fuel supply pipe in a coaxial manner, whereby a fine amount of fuel can be controlled in the idle operation of a small engine.

Recently, exhaust gas emissions control standards have been applied to small engines, and as a result, a more stabilized supply of fuel is needed in these small engines. The fuel supply pipe in the conventional rotary throttle valve type carburetor has been formed from a metal pipe with a slit-like fuel jet machined therein. However, having to machine the slit limits the shape of the fuel jet and creates a burr which is difficult to remove. Further, it is difficult to adapt the jet to the various amounts of fuel required by different engines.

On the other hand, when the fuel supply pipe is molded of synthetic resin, the fuel jet can be simultaneously molded. It is possible to adapt to the amount of fuel required by various engines from an idle position to a full open position of the throttle valve. In the fuel supply line formed of synthetic resin it is necessary to make the wall of the proximal end press-fit portion thicker than that formed of metal to ensure sufficient strength to allow the supply line to be press-fit into a mounting hole of the carburetor body. However, when the wall thickness is increased, the dimensional stability is decreased. Further, the metering tip portion, which contains the fuel jet, needs to have increased wall thickness, beyond that required for adequate strength, to be balanced for molding with respect to the proximal end press-fit portion. This increased wall thickness is needed because if there is a large variance in the wall thickness within the fuel supply line, the amount of deformation at the time of molding the resin increases, further impairing the dimensional stability.

Further, when the fuel supply pipe is press-fitted into the carburetor body the decreased dimensional stability can cause a non-concentric fit between the fuel supply pipe and the mounting hole of the carburetor body. This eccentricity can further cause a non-concentric, and hence, a poor fit and even bending between the metering tip portion of the fuel supply pipe and the needle inserted therein.

SUMMARY OF THE INVENTION

A fuel supply pipe of this invention has a molded resin fuel metering portion, with a fuel jet molded therein, concentrically mated to a metal proximal end portion which is press-fit into a rotary throttle valve type carburetor body to provide a stable fuel supply. The fuel supply is adjustable via a needle-valve which is threadably raised or lowered within the fuel metering portion of the fuel supply pipe to adjust the outlet area of the fuel jet.

According to the present invention, the assembled accuracy between the fuel supply pipe and the needle valve is enhanced. Particularly, the clearance between the fuel supply pipe and the needle is decreased, the concentricity between them is enhanced, and a change in the amount of fuel metered during use over a long period of time, is suppressed. Since the proximal end press-fit portion is made of metal it is high in mechanical strength, and not deformed when it is press-fit in the mounting hole of the carburetor body. This enables the fuel supply pipe to be concentrically fitted in the mounting hole and the needle to be concentrically fitted with respect to the fuel supply pipe.

Further, since the metering tip portion is made of synthetic resin it can be thin because it is not mated directly to the carburetor. This increases the dimensional accuracy of the metering tip portion, and it is possible to set or design the clearance between the fuel supply pipe and the needle-valve at a minimum. The inside diameter of the fuel supply pipe and the shape of the fuel jet are less changed after passage of time, thus being stable in use for a long period of time.

Objects, features and advantages of this invention are to provide a construction of a fuel supply pipe in a rotary throttle valve type carburetor which combines the ease of manufacturing of molded resin with the strength and durability of metal, provides substantially improved accuracy in metering of fuel and improved engine performance, decreases engine emissions, is of relatively simple design and economical manufacture, permits easy adjustment of the amount of fuel supplied, allows close dimensional accuracy, and in use provides a stable fuel supply for an extended period of time.

BRIEF DESCRIPTION OF THE DRAWINGS

These and other objects, features and advantages of this invention will be apparent from the following detailed description, appended claims and accompanying drawings in which:

DETAILED DESCRIPTION

Figure 1:
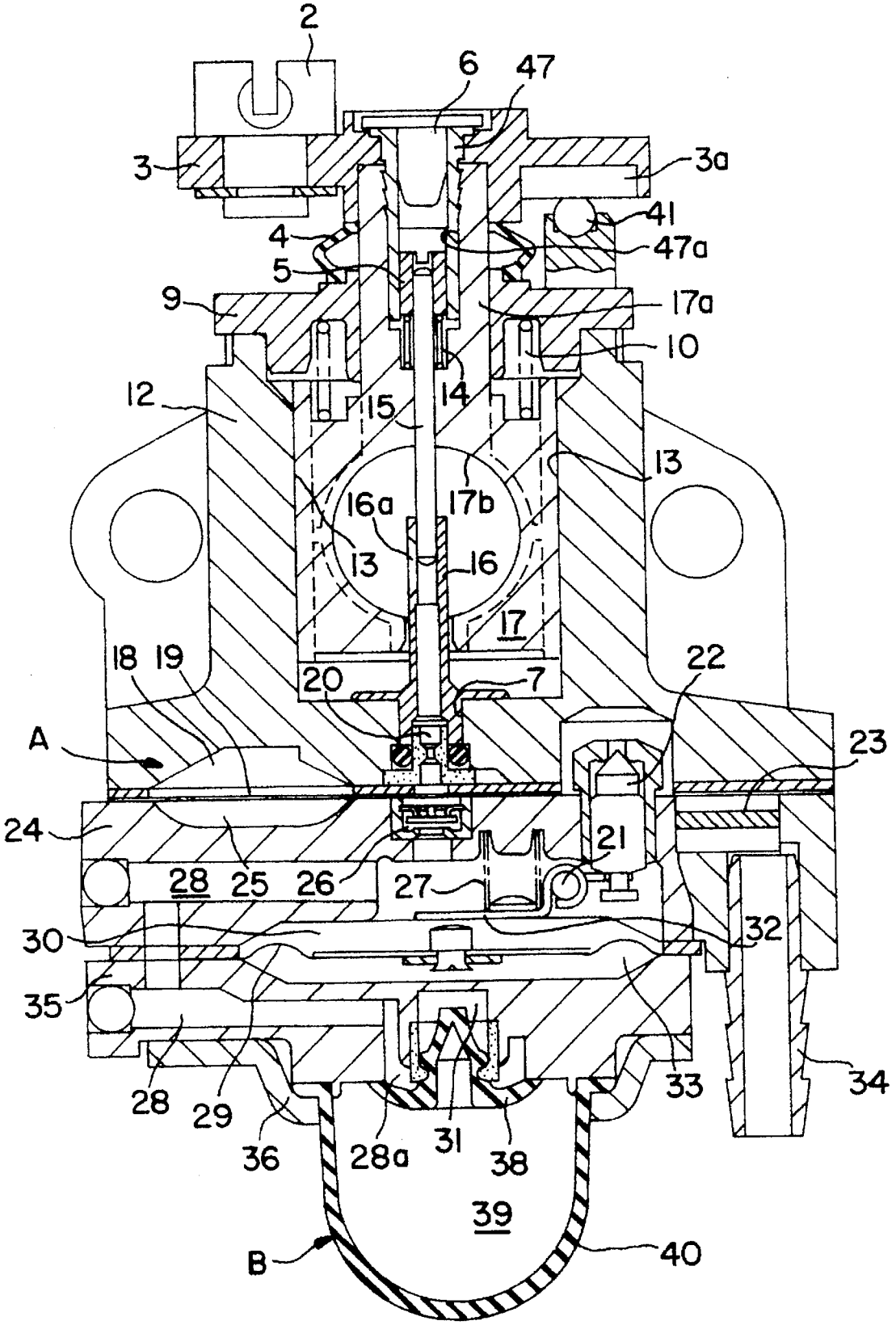
FIG. 1 is a vertical sectional view of a rotary throttle valve type carburetor embodying this invention.

As shown in FIG. 1, a carburetor body 12 of a rotary throttle valve type carburetor has an intake passage (a passage at a right angle to the plane of the page) extending across a cylindrical passage portion 13 whose lower end is closed, and a throttle valve 17 rotateably and axially movably fitted in the cylindrical portion 13 with a circular throttle hole **17*b* registerable with the intake passage. The throttle valve 17 is biased downward, by a spring 10 interposed between a cover plate 9 for closing the upper end of the cylindrical portion 13 and the throttle valve 17. The throttle valve 17 is placed in engagement with a cam mechanism, with a cam surface 3*a* on the lower face of the valve lever 3 and a follower 41 projecting upward from the cover plate 9. A valve shaft 17*a* projecting upward from the throttle valve 17 extends through the cover plate 9 and is connected to a valve lever 3. A dust boot 4 for covering the valve shaft 17*a* is interposed between the valve lever 3 and the cover plate 9. A swivel 2 supported on the valve lever 3** is connected by a cable to a remote hand-operated throttle lever for operating the engine.

The throttle valve 17 is moved upward against the force of the spring 10 in proportion to the movement of the cam surface 3*a* on the follower 41 as dictated by the rotational movement of the valve lever 3. This increases the registration area (an opening degree of the throttle valve 17) between the throttle hole 17*b* and the intake passage of the carburetor body 12, and moves upward a needle 15 supported on the throttle valve 17 with upward movement of the throttle valve 17 so that the outlet area of a fuel jet 16*a* of a fuel supply pipe 16 increases, and fuel in an amount corresponding to the opening degree of the throttle valve 17 is drawn into the throttle hole 17*b* of the throttle valve 17 from the fuel jet 16*a*.

The proximal end of the fuel supply pipe 16 is fitted in a mounting hole 7 provided in a bottom wall of the carburetor body 12, more specifically, in a bottom wall of the cylindrical portion 13, and is brought into communication with a constant pressure fuel chamber 30 for maintaining fuel at a predetermined pressure through a jet 20 provided in the bottom wall of the cylindrical portion 13 and a check valve 26. The tip of the fuel supply pipe 16 projects into the throttle hole 17*b* of the throttle valve 17.

Fuel in a fuel tank is supplied to the constant pressure fuel chamber 30 through a main fuel pump A driven by a diaphragm 19 in response to a pulsating pressure in a crankcase chamber of the engine. The diaphragm 19 is held between the carburetor body 12 and a bottom plate 24 to define a pulsating pressure introducing chamber 18 and a pump chamber 25. As the diaphragm 19 is vertically displaced, the fuel in the fuel tank is drawn into the pump chamber 25 through an inlet pipe 34, a filter 23 and a passage provided with a check valve (not shown), and further supplied to the constant pressure fuel chamber 30 through a passage provided with a check valve (not shown) and a flow valve 22.

The constant pressure fuel chamber 30 is defined above a diaphragm 29 held between the bottom plate 24 and a cover 35, and an atmospheric chamber 33 below the diaphragm 29. A lever 32, pivotally supported by a support shaft 21 in the constant pressure fuel chamber 30 of the bottom plate 24, has one end engaged with the flow valve 22 and the other end engaged with a protrusion in the center of the diaphragm 29 and is raised by a spring 27. When the fuel in the constant pressure fuel chamber 30 decreases, the diaphragm 29 and the lever 32 are pushed up against the force of the spring 27 by the air pressure in the atmospheric chamber 33 so that the lever 32 is turned clockwise about the support shaft 21 to open the flow valve 22, and the fuel in the pump chamber 25 is supplied to the constant pressure fuel chamber 30 through the flow valve 22. When the fuel in the constant pressure chamber 30 increases, the diaphragm 29 is pushed down so that the lever 32 turns counterclockwise about the support shaft 21 to close the flow valve 22.

A dome 40 of a hand-operated auxiliary fuel pump B has its peripheral edge portion connected to the lower surface of the cover 35 by an annular keeper plate 36, and a composite inlet and outlet check valve 38 is engaged at the cylindrical outlet chamber 31 provided in the center of the cover 35. The composite check valve 38 closes, at the peripheral edge of a bevel portion thereof, between the inlet 28*a* connected to the constant pressure fuel chamber 30 and a pump chamber 39, and closes, at the flatly compressed central cylindrical portion thereof, between the pump chamber 39 and an outlet chamber 31.

In the case where no fuel is present in the constant pressure fuel chamber 30 before the start of the engine, the dome 40 of the hand-operated auxiliary fuel pump B is compressed. Air is drawn from the constant pressure fuel chamber 30 through a passage 28 into an inlet 28*a* until it pushes open a peripheral edge of the composite check valve 38 and is drawn into the pump chamber 39. Compressing the dome again forces the air in the pump chamber 39 through the flatly compressed cylindrical central portion of the composite check valve 38, and into the outlet chamber 31. The air is then discharged out of an outlet not shown. The process is repeated so that when the constant pressure fuel chamber 30 assumes a negative pressure, the fuel in the fuel tank is drawn into the pump chamber 25 through an inlet pipe 34, a filter 23 and a passage provided with a check valve (not shown) and further supplied to the constant pressure fuel chamber 30 through a passage provided with a check valve (not shown) and the flow valve 22.

A cylindrical member 47 is fitted and secured, in a manner not to be slipped out, to a cylindrical tubular portion 47*a* provided in the center of an upper end portion of the valve shaft 17*a* of the throttle valve 17. The upper end of the needle 15 is fitted and secured to a head 5 threadably fitted in the cylindrical member 47. A spring 14 is interposed between the head 5 and the bottom wall of the cylindrical portion 47*a* of the valve shaft 17*a*. A cap 6 is fitted over the upper end portion of the cylindrical member 47. Accordingly, when the head 5 is threadably turned, the relative position between the lower end of the needle 15 and the fuel jet 16*a* is adjusted.

Figure 4:
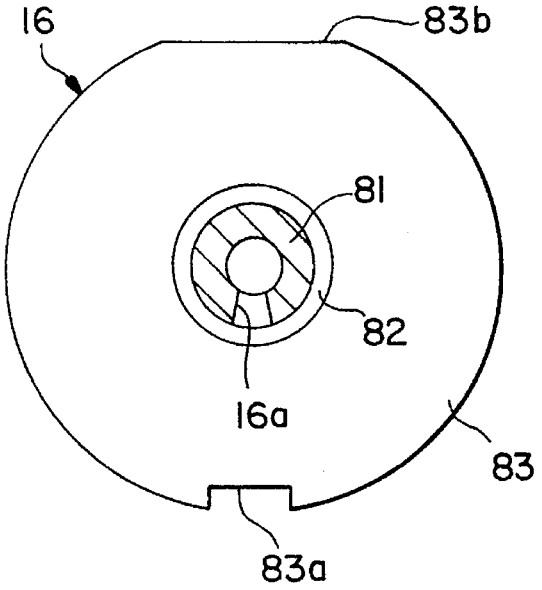
FIG. 4 is a cross sectional view of the fuel supply pipe.
Figure 2:
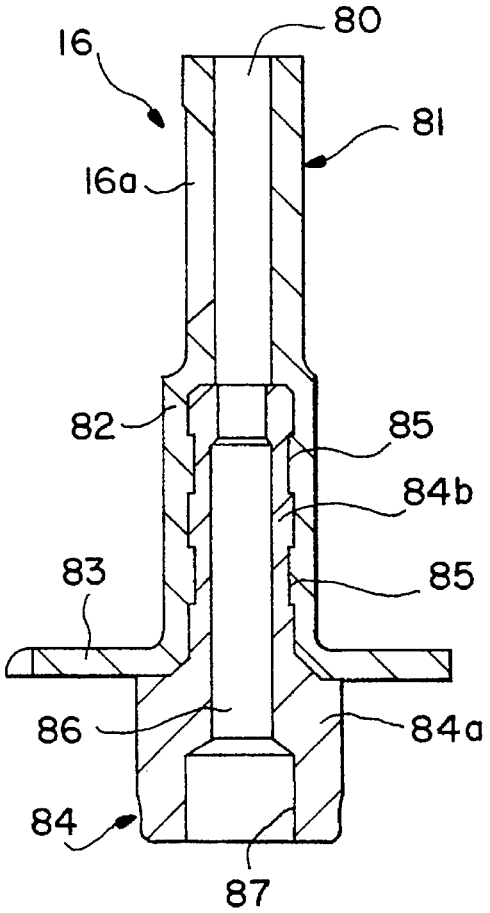
FIG. 2 is a vertical sectional view of the fuel supply pipe.
Figure 3:
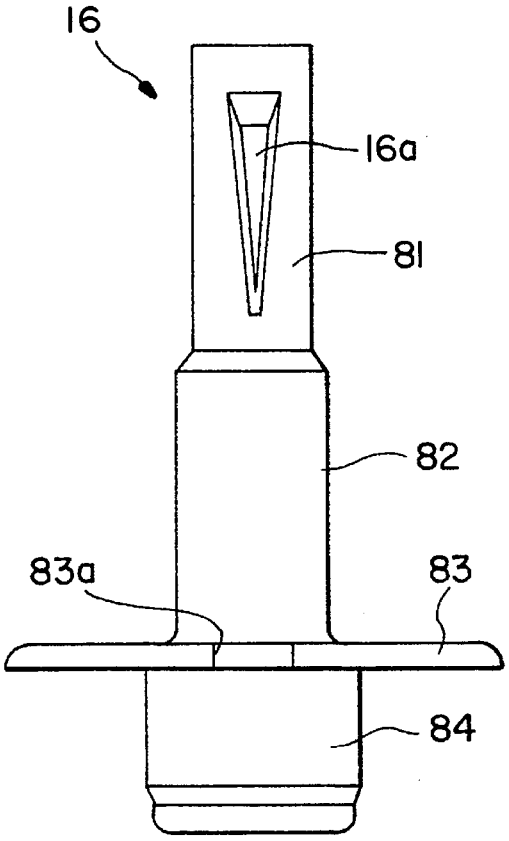
FIG. 3 is a front view of the fuel supply pipe.

As shown in FIGS. 2 to 4, according to the present invention, the fuel supply pipe 16 is composed of a proximal end press-fit portion 84 formed of metal such as aluminum and a metering tip portion 81 formed of synthetic resin. The proximal end press-fit portion 84 is composed of a large-diameter shaft portion 84*a* fitted in the mounting hole 7 (FIG. 1) of the carburetor body 12, and a pipe or tubular portion 84*b* being formed in its outer surface with a plurality of annular grooves 85 in order to provide a close fit relative to the metering tip portion 81. The proximal end press-fit portion 84 is formed at its lower end with a large diameter cylindrical portion 87 to fit the jet 20 (FIG. 1) therein, the large diameter cylindrical portion 87 being communicated with an axial passage 86.

The metering tip portion 81 has an integral disk-like flange 83 which comes in contact with and is located at the bottom wall surface of the carburetor body 12, and is integrally formed of resin so that a large-diameter pipe or tubular portion 82 comes in close contact with an annular groove 85 of the proximal end press-fit portion 84. The flange 83 has its edge portion 83*b* linearly cut and a notched groove 83*a* formed opposite the straight edge portion 83*b*. The needle 15 (FIG. 1) is fitted into a passage 80 at the upper end of the metering tip portion 81 which is axially connected to a passage 86 in the proximal end press-fit portion 84. The passage 80 in the metering tip portion 81 is formed with an inverted-triangular fuel jet 16*a* in its peripheral wall.

According to the present invention, as described above, the proximal end press-fit portion of the fuel supply pipe is formed of metal, and the metering tip portion of the fuel supply pipe is formed of synthetic resin. The two portions are integrally connected so that the end of the metering tip portion which contains the flange 83 is fitted over the distal end of the proximal end press-fit portion. With this arrangement, the dimensional accuracy of the fuel supply pipe and the needle, and the concentricity therebetween, is enhanced. Therefore, the stable and optimal fuel amount can be obtained in use for a long period of time.

The proximal end press-fit portion of the fuel supply pipe has sufficiently high mechanical strength such that when the fuel supply pipe is press-fitted in the mounting hole of the carburetor body the fuel supply pipe is not deformed, providing increased concentricity with the mounting hole.

Further, because the metering tip portion of the fuel supply pipe is not directly connected to the carburetor body, the metering tip portion can be made thin, enhancing the dimensional accuracy of the metering tip portion and allowing the clearance between the fuel supply pipe and the needle to be set to a minimal level. Even if the dimensional accuracy of the mounting hole of the carburetor body is less than that of the fuel supply pipe, the desired concentricity between the fuel supply pipe and the needle can be obtained.

Since the wall thickness of the metering tip portion formed of synthetic resin is substantially uniform, the dimensional accuracy is enhanced, the residual stress of the whole resin is small, the change after passage in the inside diameter of the fuel supply pipe and in the shape of the fuel jet is small, and the fuel supply pipe is stable for a long period of use.

I claim:

1. In a carburetor with a rotary throttle valve, a fuel supply pipe comprising;

a first tubular portion constructed of metal having a tubular passage to allow fuel flow therethrough and adjacent one end an outside diameter slightly larger than the diameter of the corresponding mounting hole on the carburetor where said portion is fitted to provide an interference fit therein, and a second tubular portion formed of synthetic resin, having a tubular passage to slidably receive a needle valve therein and to allow fuel flow therethrough, and a fuel jet orifice formed in the sidewall of the metering tip portion to allow delivery of fuel from said second portion, said first and second portions are telescopically connected such that the passage of the first portion is in communication with the passage of the second portion.

2. The fuel supply pipe of claim 1 with the first and second portion telescopically connected such that the outside diameter of one portion is slightly larger than the corresponding inside diameter of the other portion, into which it is fitted, to provide an interference fit between the two portions.

3. The fuel supply pipe of claim 1 wherein the fuel jet orifice has a triangular shape.

4. The fuel supply pipe of claim 3 wherein the triangular fuel jet orifice is oriented such that the apex of the triangular fuel jet orifice is positioned nearer the first tubular portion than the base of said triangular fuel jet.

5. The fuel supply pipe of claim 1 having a flange on the second tubular portion formed at the end that is connected to said first tubular portion.

6. The fuel supply pipe of claim 1 wherein said second tubular portion has substantially the same wall thickness substantially throughout its axial length.

* * * * *